US005091631A

United States Patent [19]

Dupuis et al.

[11] Patent Number: 5,091,631

[45] Date of Patent: Feb. 25, 1992

[54] GLOW PLUG HAVING A SERIES CONNECTION OF RESISTANT FILAMENTS

[75] Inventors: Bertram Dupuis; Max Endler, both of Ludwigsburg; Paul Bauer, Steinheim/Murr, all of Fed. Rep. of Germany

[73] Assignee: Beru Ruprecht GmbH & Co. KG, Ludwigsburg, Fed. Rep. of Germany

[21] Appl. No.: 383,094

[22] Filed: Jul. 21, 1989

[30] Foreign Application Priority Data

Jul. 22, 1988 [DE] Fed. Rep. of Germany ..... 3825013

[51] Int. Cl.[5] ..... F23Q 7/22

[52] U.S. Cl. ..... 219/270; 219/205; 219/504; 219/505; 219/552; 219/553; 123/145 R; 361/266

[58] Field of Search ..... 219/270, 205–207, 219/504, 505, 552, 553; 123/145 R, 298; 361/264, 266

[56] References Cited

U.S. PATENT DOCUMENTS 4,556,781 12/1985 Bauer ..... 219/270
4,582,980 4/1986 Izzi ..... 219/270
4,733,053 3/1988 Mueller ..... 219/270

FOREIGN PATENT DOCUMENTS 1927334 8/1977 Fed. Rep. of Germany .

OTHER PUBLICATIONS

Werkstoffkunde Stahl, p. 646, vol. 2.

*Primary Examiner*—Bruce A. Reynolds
*Assistant Examiner*—Tu Hoang
*Attorney, Agent, or Firm*—Sixbey, Friedman, Leedom & Ferguson

[57] ABSTRACT

A glow plug for an air compressing internal combustion engine of the type having a tube which is closed at one end and connected to a plug housing on an opposite end with a wire filemant-like resistance element disposed in an insulating material within the tube and formed two series-connected resistance filaments, of which the rear resistance filament, serves as a regulating filament, having a higher positive temperature resistance coefficient than the front resistance filament, which serves as a heating filament, is improved so as to enable the heating up time to be reduced without adversely impacting upon the effective life of the glow plug. In accordance with various embodiments, this result is achieved through the use of, for example, special alloys for the material of the regulating filament which have a resitance at 1000° C. that is greater than their resistance at 20° C. by a resistance ratio over about 7.5:1, and preferably greater than 12:1, and in particular, about 14:1.

16 Claims, 5 Drawing Sheets

GLOW PLUG HAVING A SERIES CONNECTION OF RESISTANT FILAMENTS

The invention relates to a glow plug.

When the engine is cold, in other words below the self-starting temperature, air compressing internal combustion engines have to be started by means of glow plugs or heater plugs.

The aforesaid glow plugs take a certain time to heat up to their working temperature. Only then can the internal combustion engine be started. This period of time, also referred to as the preliminary heating time, is already quite short in the case of known plugs. Nevertheless, compared with a petrol engine, it is still relatively long since the petrol engine is immediately ready for starting.

Therefore, the constant endeavour is to shorten the preliminary heating time as far as possible.

A known glow plug for disposition in the combustion chamber of an air-compressing internal combustion engine comprises a plug housing, with a connection device for the glow current and with, fixed on the plug housing, a tube which is closed at its end remote from the plug housing, a wire filament-like resistance element being disposed in an insulating material within the tube, the resistance element consisting of two series-connected resistance filaments, of which the rear resistance filament, serving as a regulating filament, has a higher positive temperature resistance coefficient than the front resistance filament which is used as a heating filament.

Where the prior art sheathed-element glow plugs are concerned, the regulating filament is normally made from pure nickel, in which case the resistance ratio is about 7, related to a temperature ratio of 20°/1000° C., i.e. the resistance at 1000° C. is about 7 times as great as it is at 20° C. In this way, sheathed-element glow plugs can be produced with a heating up time of somewhere between 5 to 10 seconds; at the tip of the glow plug tube, then, the temperature is about 850° C. while after about 10 seconds, an equilibrium temperature sets in which is about 1140° C. at nominal voltage.

The object of this invention, while avoiding the drawbacks known from the state of the art, is to make available sheathed-element glow plugs having a heating up time which is markedly reduced in comparison with that of the prior art sheathed-element glow plugs, a sufficient effective life of the glow plugs being at the same time ensured. At the same time, such sheathed-element glow plugs should be easily produced and make it possible to dispense with the use of control appliances in order to resolve the problem posed. The invention likewise relates to a method of producing such sheathed-element glow plugs.

Figure 1:
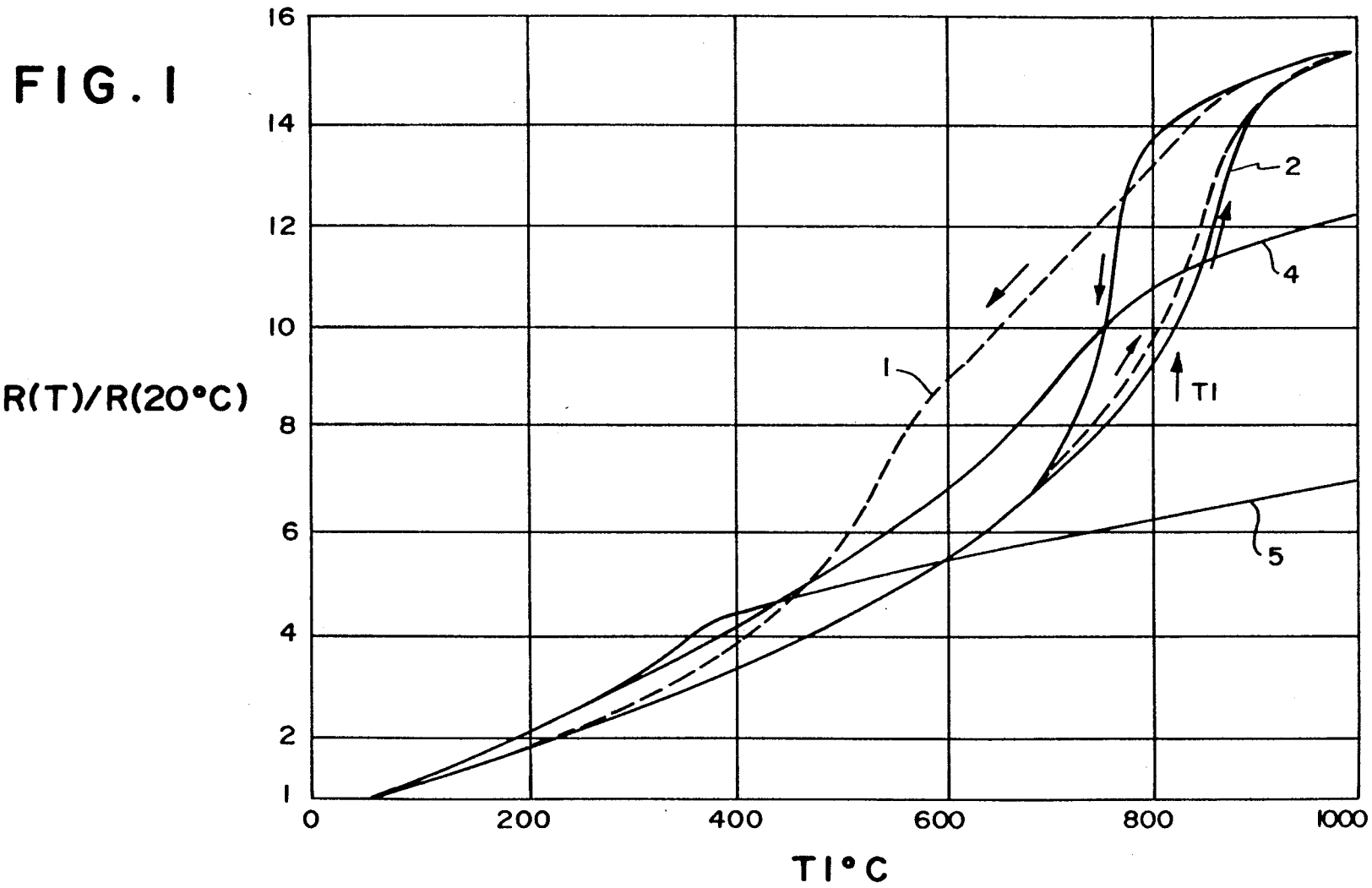
FIGS 1 & 2 are graphs depicting the resistance ratio as a function of temperature for materials in accordance with the invention and for prior art materials.

It has been found that theoretically by varying the filament geometry of the filament and the construction of the sheathed element, heating up times of less than 5 seconds can be achieved, although their effective life is completely inadequate for the desired purpose. It has been found that this is above all due to the fact that the rapid heating up period cannot be halted, so that the heater rod settles down to an equilibrium temperature of more than 1130° at a normal battery voltage after about 10 seconds, but as was found by the Applicants, this temperature has a decisively adverse affect on the effective life of such sheathed-element glow plugs.

If, on the other hand, the regulating filament used is a resistance filament with a higher resistance, it is not possible to achieve the desired shortening of the heating up time if the target equilibrium temperature is about 1000° C.

Surprisingly, it has been found that it is possible both to reduce the heating up time and also achieve a functionally viable effective life by using for the regulating filament a material having a resistance ratio of greater than about 7.5 and preferably greater than 12 and in particular of about 14.

Suitable materials are not, as known from the state of the art, pure nickel but are special alloys, for example alloys of nickel-iron and cobalt-iron, particularly cobalt-iron.

Suitable materials for the regulating filament having a high positive temperature coefficient of electrical resistance are, to achieve a high ratio of resistance values at temperatures above 750° C. and at room temperature as well as a non-linear initially flat and then steep rise in resistance with the temperature, alloys which exhibit a cubically three-dimensionally centred structure at room temperature, which upon heating in the range between room temperature and 1000° C. merges into a cubically two-dimensionally (plane) centred structure and which consist of 20–35% by weight iron, other elements, e.g. processing additives up to 1% by weight, the balance being cobalt and optionally nickel. In the case of the processing additives, the use and amount of such additives is known it the art and includes such deoxidation and processing additives as silicon and manganese.

Surprisingly the very best results can be achieved by a material within very small limits of Fe, namely 23 to 25% Fe, preferably 25% Fe, the balance being Co.

Eventhough the reasons are not yet known the best results can be achieved if this alloys are produced by a sintering process instead of a melting or fusion process. Consequently, the alloys produced by sintering are most preferred.

Materials which have been found to be particularly suitable are those which not only have the aforesaid resistance ratio but in which the variation in resistance occurs suddenly in a specific temperature range, i.e. varying in a not substantially linear fashion as with pure nickel but very rapidly in relation to the rest of the pattern of the curve, in the range from 600° to 900° C. This is demonstrated by the curves in FIG. 1A, in which the pattern of the resistance ratio is shown diagrammatically as a function of the temperature of the materials mentioned.

Figure 2:
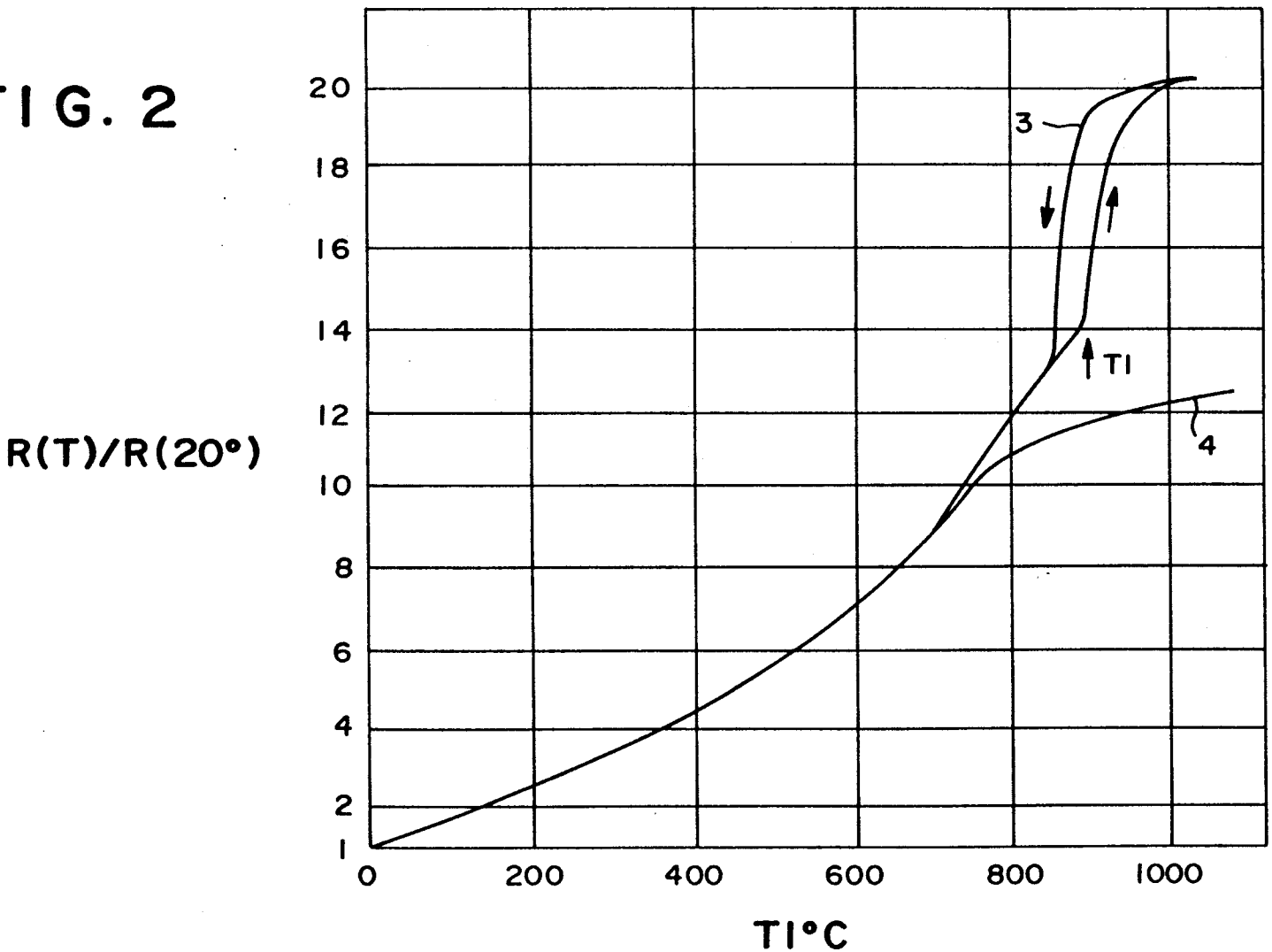
Figure 2A:
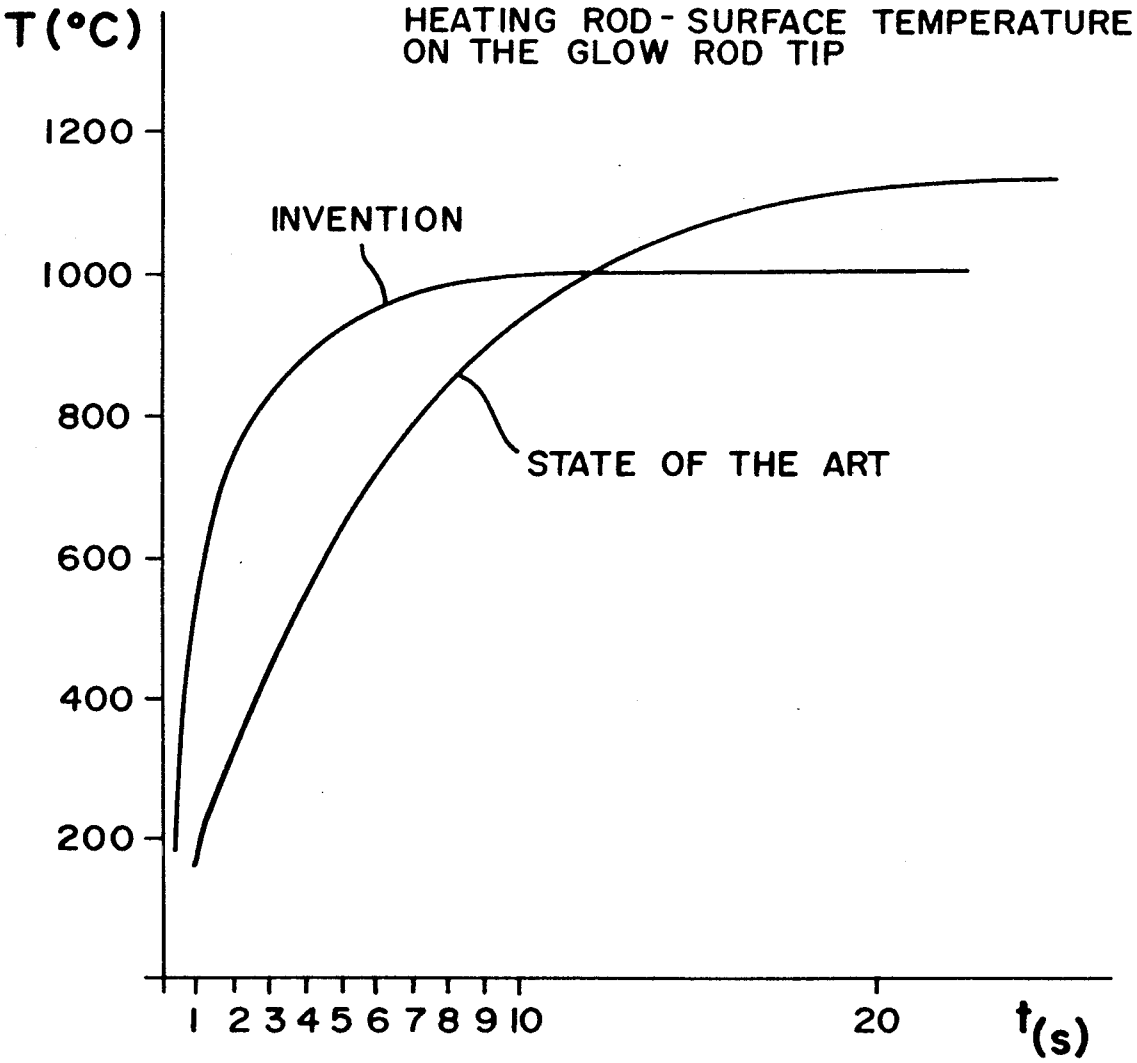
FIG. 2A is a graph depicting the difference in performance characteristics of a glow plug in accordance with the present invention in comparison to the a prior art glow plug with regard to their surface temperature as a function of time.

Sheathed-element glow plugs constructed according to the invention correspondingly show the behaviour illustrated in FIG. 2A with regard to their surface temperature and as a function of the time factor. Whereas in the case of the example shown the sheathed-element glow plug from the state of the art has reached a temperature at the tip of the sheathed element of about 850° C. after some 8 seconds, the sheathed-element glow plug according to the invention reaches this temperature after about 3 to 4 seconds. Furthermore, the illustration shows that the sheathed-element glow plug according to the invention is very sharply "halted" in terms of its surface temperature and settles down according to FIG. 2A to an equilibrium temperature of about 1000° C., whereas the prior art sheathed-element glow plug settles down to an equilibrium temperature of somewhat above 1150° C.

The low equilibrium temperature of the glow plug according to the invention improves not only the effective life of the glow plug quite considerably but above all it also means that while the engine is running and is at a higher generator voltage (up to 13 volts at the plug), secondary heating is possible with this plug without destroying the heating and regulating filament; this possibility of secondary heating is quite significant as a way of diminishing harmful substances in the exhaust gas from diesel engines. In this way, it is possible to dispense with the complicated electrical or electronic control arrangements which would otherwise need to be provided in the base of secondary heating (afterglowing).

Figure 3A:
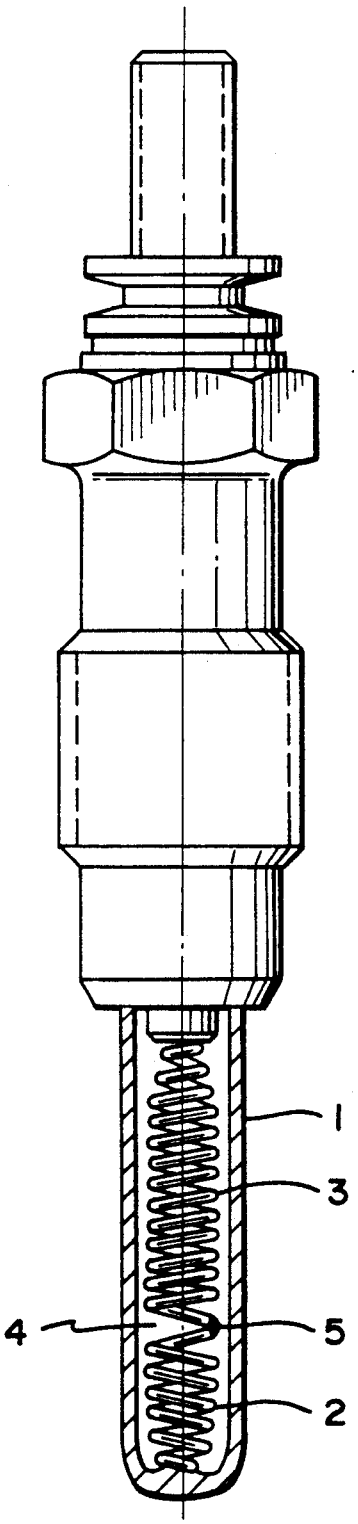
FIGS. 3A & 4A are partial cross-sectional views of two preferred embodiment glow plugs in accordance with the present invention.

A typical embodiment of the sheathed-element glow plug according to the invention is shown in FIG. 3A.

The glow plug element 1, constructed as a closed glow plug tube, normally consists of a corrosion-resistant material, preferably Inconel 600 or 601.

Embedded in a readily heat-conductive insulating material 4 (for example magnesium oxide) in this protective tube there is a combination filament 2 and 3.

The front portion 2 of the serially disposed filaments is described as the heating filament and consists of wire stock having a low positive or negative temperature coefficient, preferably a chrome-aluminium-iron wire. The diameter of the wire is usually 0.3 to 0.5 mm.

The heating filament 2 is connected to the regulating filament 3 normally by welding. In this case, the regulating filament consists of a cobalt-iron alloy, the proportion of cobalt in the alloy being about 75% while the balance is iron; according to the invention, it is possible in this way to use a material of which the resistance characteristic is adapted to the application of a glow plug. This regulating filament 3 has according to the invention initially a lower increase in resistance, while the resistance in the region of the filament wire at temperature rises sharply from about 400° to about 900° C.

Likewise according to the invention, the desired equilibrium temperature settles down after about 8 seconds. The glow temperature of about 850° C. is attained already after 2 to 5 seconds. The diameter of the regulating filament in this example is about 0.3 to 0.4 mm.

Figure 4A:
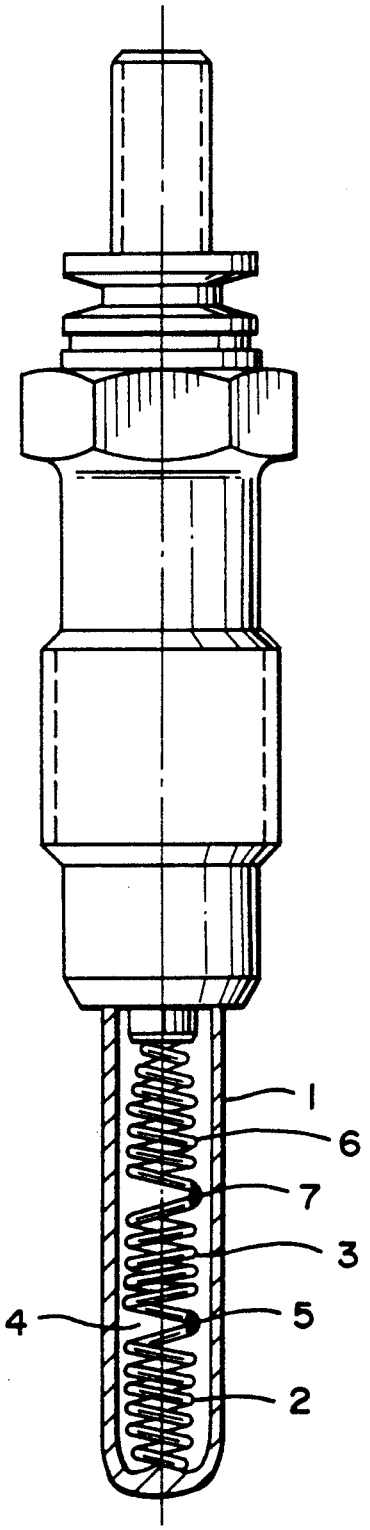

A preferred embodiment of the glow plug according to the invention is shown in FIG. 4A. This glow plug comprises a regulating filament comprising two filaments 3 and 6, filament 3 consisting of the cobalt/iron alloy according to the invention and being situated between heating filament 2 and additional filament 6, which is closest to the plug housing and filament 6 of per se known filament of for example pure Ni or a material comparable with pure Ni in terms of resistance properties. Such combination of filaments as regulating filament allows perfect tailoring of the regulating filament with respect to the specific requirement of a regulating filament in accordance with the present invention.

Examples of alloys which can be used according to the invention will emerge from the following table:

TABLE I

| | Composition | | | | | | Spec. resistance/μΩ cm at | | |
|---|---|---|---|---|---|---|---|---|---|
| | Co | Fe | Ni | Mn | Si | Tl/°C. | at 20° C. | 1000° C. | TF |
| a) | 79 | 21 | — | — | — | 750 | 6.4 | 98 | 15 |
| b) | 77 | 23 | — | — | — | 780 | 5.8 | 98 | 16 |
| c) | 75 | 25 | — | — | — | 825 | 5.7 | 100 | 17.5 |
| d) | R | 25 | — | 0.2 | 0.1 | 825 | 6.7 | 103 | 15 |
| e) | 71 | 29 | — | — | — | 900 | 5.5 | 108 | 20 |
| f) | R | 25 | 5 | 0.2 | 0.1 | 810 | 5.8 | 98 | 17 |
| g) | R | 30 | 10 | 0.2 | 0.1 | 850 | 5.8 | 96 | 16.5 |

The material for the regulating filament of the invention is a material which permits of an even greater heating-up speed and which at the same time has an improved regulating behaviour.

If, in order to represent the resistance characteristics of materials for resistance elements having a positive temperature coefficient, we choose the temperature factor TF=R(1000° C.)/R(20° C.), which indicates the resistance ratio at a temperature of 1000° C. and at room temperature, then TF=4 for platinum, 7 for nickel and 12 for iron. On the other hand, temperature factors TF>12 can be achieved with the material according to the invention. Furthermore, where the material according to the invention is concerned, the resistance curve as a function of the temperature shows a pattern which favours short heating-up times.

Figure 1A:
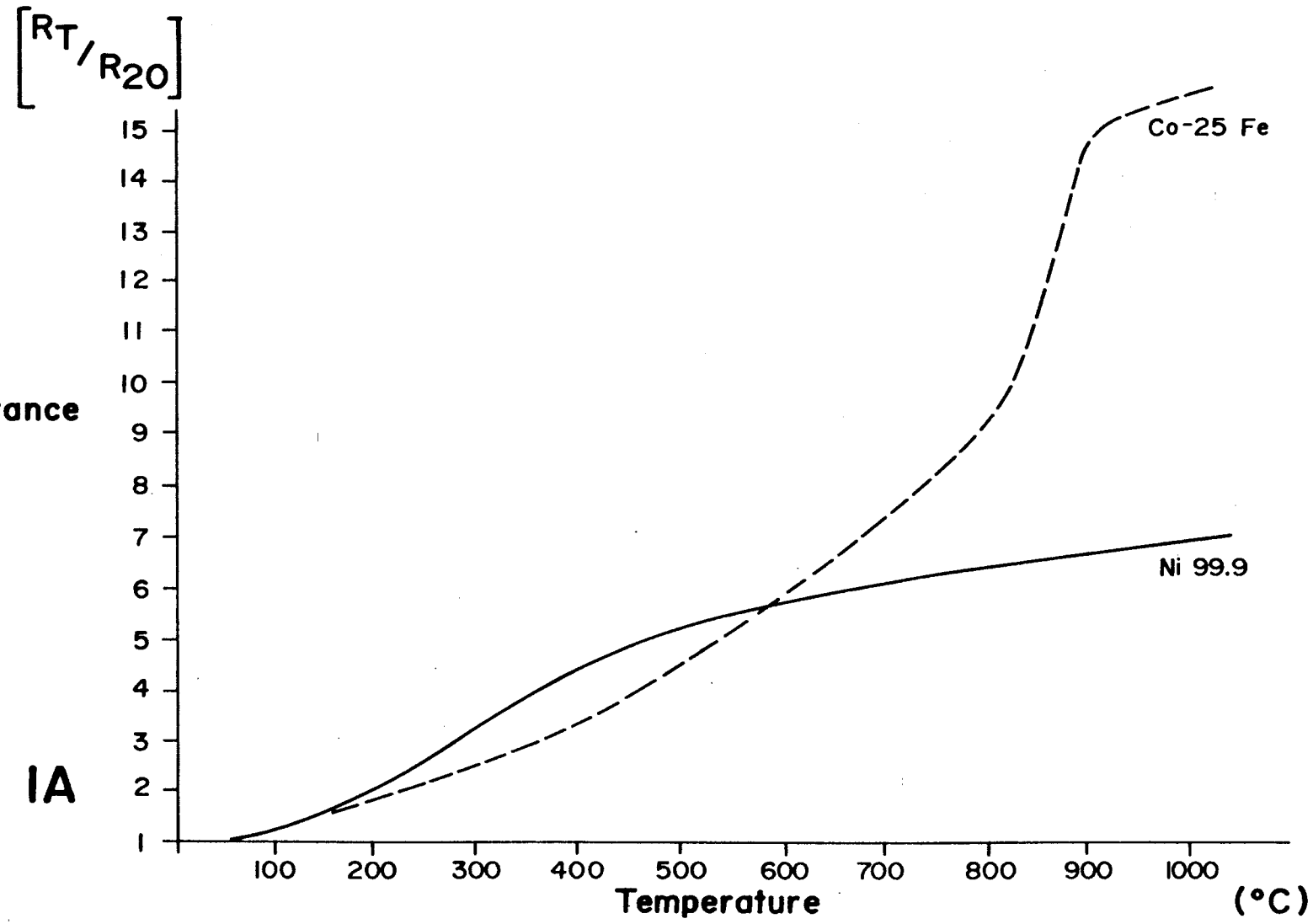
FIG. 1A is a graph depicting the resistance ratio as a function of temperature for other materials in accordance with the present invention.

The invention will be explained in greater detail with reference to the examples of embodiment listed in the Table and, as illustrated in FIGS. 1 and 2, the resistance ratio R(T)/R(20° C.) as a function of the temperature for materials according to the invention and for materials according to the state of the art.

One essential advantage of this material, when used for resistance elements, is the special pattern of the resistance curve as a function of the temperature. FIG. 1 shows the resistance ratio R(T)/R(20° C.) for an alloy consisting of 79% by weight cobalt and 21% by weight of iron (1), and for an alloy consisting of 75% by weight cobalt and 25% by weight iron (2). FIG. 2 shows the corresponding resistance ratio for an alloy with the composition of 71% by weight cobalt and 29% by weight iron (3). The pattern of the resistance ratio of the materials according to the invention shows a relatively minimal rate of rise up to the temperature Tl which is then followed by a steep, and to a certain extent even abrupt rise. Therefore, it encourages short heating-up times when temperatures of around 1000° C. have to be attained.

The cause of this particular pattern of the resistance curve lies in a phase conversion. At room temperature, the material according to the invention exhibits a cubically space-centred structure (α), in the range between 750° and 900° C. there is a transition towards a cubically plane centered or two-dimensional centred structure (γ). The conversion temperature Tl is dependent upon the proportion of iron in the relevant alloy composition and it rises as the iron content increases. Upon cooling, the change from the cubically plane (two-dimensionally) centred structure (γ) to the cubically three-dimensionally centred structure (α) takes place at a temperature which is lower than Tl, producing an hysteresis curve. The hysteresis becomes smaller as the iron content increases.

Also, for purposes of comparison, FIGS. 1 and 2 further show in curve 4 the resistance ratio R(T)/R(20° C.) for iron and in FIG. 1, curve 5 shows the same for nickel, in other words for materials for resistance elements with a positive temperature coefficient according to the state of the art. Curve 5 for nickel flattens out already at a temperature of less than 400° C. while that for iron does so at a temperature of 800° C. This flattening out can be attributed to the Curie temperature having been reached.

The pattern of resistance ratios for the material according to the invention, on the other hand, initially shows a relatively flat rise so that higher heating up rates are possible. When the $\alpha/\gamma$ conversion temperature Tl is attained, the resistance then climbs sharply while the current intensity and thus the heat produced will correspondingly show a sharp drop. This self-regulating feature makes it possible quickly to attain the final temperature without the resistance element itself being damaged The $\alpha/\gamma$ conversion occurs in cobalt-iron alloys when the iron content is more than 20% by weight. The alloys can additionally also contain nickel, but only up to such a proportion that the cubically three-dimensionally centred structure is retained at room temperature. The admissible proportion of nickel rises as the iron content increases. The maximum nickel content at which the alloy exhibits a cubically three-dimensionally centred structure at room temperature can be ascertained virtually by linear interpolation between the values of about 0% by weight for an iron content of 20% by weight and 15% by weight with an iron content of 35% by weight. With an iron content of 25% by weight, the proportion of nickel cannot be more than 5% by weight and with an iron content of 30% by weight, it cannot exceed 10% by weight. In addition, the alloys may contain other elements, e.g. as processing additives with a proportion of up to 1% by weight.

The alloys according to the invention can easily be transformed while cold and can be readily worked to produce wire, strip or the like. Alloys with an iron content of more than 35% by weight on the other hand become increasingly brittle as a result of the orientation which they assume.

EXAMPLES

The Table lists the $\alpha/\gamma$ conversion temperature Tl, the specific electrical resistance at room temperature and at 1000° C. and the resultant temperature factor TF both for materials for the regulating filament according to the invention and also for iron and nickel.

Example a): An alloy consisting of 79% by weight cobalt and 21% by weight iron was produced by a sintering process. For this alloy composition, the $\alpha/\gamma$ conversion temperature is 750° C. From the values for specific resistance at room temperature and at 1000° C., the temperature factor TF can be calculated as 15.

Example b): For an alloy likewise produced by a sintering method, and consisting of 77% by weight cobalt and 23% by weight iron, the $\alpha/\gamma$ conversion temperature Tl is 780° C. while the temperature factor TF=16.

Example c): An alloy with a composition of 75% by weight cobalt and 25% by weight iron, likewise produced by a sintering process, had the following values: Tl=825° C., TF=17.5.

Example d): An alloy of substantially the same composition as in Example c) was produced by a fusion process For this purpose, 0.2% by weight manganese and 0.1% by weight silicon were incorporated as processing additives, the iron content was 25% by weight and the balance consisted of cobalt. The $\alpha/\gamma$ conversion temperature Tl was unaltered in comparison with the alloy from Example c), produced by sintering. Due to the processing additives, however, the specific resistance was higher. Consequently, also the temperature factor TF, at 15, was also somewhat lower than in the case of the sintered material in Example c), with no alloy additives.

Example e): A material with a composition of 71% by weight cobalt and 29% by weight iron was produced by sintering. The $\alpha/\gamma$ conversion temperature Tl amounted to 900° C. and a value for the temperature coefficient was ascertained: TF=20. Comparison with the above-mentioned examples which have a lower iron content shows that both the $\alpha/\gamma$ conversion temperature Tl and also the temperature factor TF increase with the proportion of iron.

Example f): A material produced : by fusion and having a composition of 25% by weight iron, 5% by weight-nickel, 0.2% by weight manganese and 0.1% by weight silicon as processing additives, and the balance cobalt, exhibited an $\alpha/\gamma$ conversion temperature Tl of 810° C. and a temperature factor TF of 17.

Example g): A material produced by fusion and having a composition of 30% by weight iron, 10% by weight nickel, 0.2% by weight manganese and 0.1% by weight silicon as processing additives, the balance cobalt, had an $\alpha/\gamma$ conversion temperature Tl of 850° C. and a temperature factor TF of 16.5. Therefore, even with alloys which have a proportion of nickel, it is possible to achieve high temperature coefficients TF. As the proportion of nickel further increases, however, the alloys even at room temperature start to exhibit a cubically two-dimensionally (plane) centred structure and the special characteristics of the resistance curve which is based on the transition from cubically three-dimensionally to cubically two-dimensionally (plane) centred structure is lost.

The examples listed in Table I demonstrate that it is possible with a material according to the invention to attain a temperature factor TF which is greater than 12, i.e. a temperature factor which is greater than in the case of the hitherto known materials for regulating filaments having a positive temperature coefficient eventhough they can also be used advantageously directly as the heating element.

We claim:

1. A glow plug for disposition in the combustion chamber of an air-compressing internal combustion engine, with a plug housing, with a connection device for a glow current and with, fixed on the plug housing, a tube which is closed at its end remote from the plug housing, a wire filament-like resistance element being disposed in an insulating material within the tube, the resistance element consisting of two series-connected resistance filaments, of which the rear resistance filament, serving as a regulating filament, has a higher positive temperature resistance coefficient than the front resistance filament which is used as a heating filament, characterized in that the regulating filament which is made of material having a resistance at 1000°

C. that is greater than its resistance at 20° C. by a resistance ratio over 7.5:1.

2. A glow plug according to claim 1, characterized in that the resistance ratio is greater than 12:1.

3. A glow plug according to claim 2, characterized in that the resistance ratio is about 14:1.

4. A glow plug according to claim 1, characterized in that the regulating filament material shows a sharp rise in resistance in a region of the regulating filament wire at temperatures of about 400° up to about 900° C.

5. A glow plug for disposition in the combustion chamber of an air-compressing internal combustion engine, with a plug housing, with a connection device for a glow current and with, fixed on the plug housing, a tube which is closed at its end remote from the plug housing, a wire filament-like resistance element being disposed in an insulating material within the tube, the resistance element consisting of two series-connected resistance filaments, of which the rear resistance filament, serving as a regulating filament, has a higher positive temperature resistance coefficient than the front resistance filament which is used as a heating filament, characterized in that the regulating filament which is made of material having a resistance at 1000° C. that is greater than its resistance at 20° C. by a resistance ratio over 7.5:1; characterized in that the regulating filament consists of a nickel-iron alloy.

6. A glow plug according to claim 4, characterized in that the regulating filament consists of a nickel-iron alloy.

7. A glow plug according to claim 1, characterized in that the regulating filament consists of a cobalt-iron alloy which consists of 20–35% by weight Fe, up to 1% by weight deoxidation processing additives, and the remainder is Co and optionally Ni.

8. A glow plug according to claim 4, characterized in that the regulating filament consists of a cobalt-iron alloy which consists of 20–35% by weight Fe, up to 1% by weight deoxidation processing additives, and the remainder is Co and optionally Ni.

9. A glow plug according to claim 7, characterized in that the cobalt-iron alloy of the regulating filament has a nickel content which increases with its percentage by weight of iron, a maximum value of the percentage by weight of nickel being ascertained by a virtual linear interpolation between the following values: 0% by weight nickel for an iron content of 20% by weight and 15% by weight nickel for an iron content of 35% by weight.

10. A glow plug according to claim 8, characterized in that the cobalt-iron alloy of the regulating filament has a nickel content which increases with its percentage by weight of iron, a maximum value of the percentage by weight of nickel being ascertained by a virtual linear interpolation between the following values: 0% by weight nickel for an iron content of 20% by weight and 15% by weight nickel for an iron content of 35% by weight.

11. A glow plug according to claim 7, characterized in that the regulating filament is constructed in at least one piece of at least one material of which the resistance ratio is less than 7.5:1 in a temperature range from about 100° up to a temperature between 400° C. to 600° C. and rises sharply to a value greater than 12:1 in a temperature range up to 900° C.

12. A glow plug according to claim 8, characterized in that the regulating filament is constructed in at least one piece of at least one material of which the resistance ratio is less than 7.5:1 in a temperature range from about 100° up to a temperature between 400° C. to 600° C. and rises sharply to a value greater than 12:1 in a temperature range up to 900° C.

13. A glow plug according to claim 12, characterized in that the cobalt-iron alloy contains 23–25% by weight of Fe and the remainder being Co.

14. A glow plug according to claim 13, characterized in that the regulating filament is directly connected to an additional filament, the regulating filament being adjacent to the heating filament, and the additional filament being adjacent to the tube of the glow plug housing and consisting of Ni.

15. A glow plug for disposition in the combustion chamber of an air-compressing internal combustion engine, with a plug housing, with a connection device for a glow current and with, fixed on the plug housing, a tube which is closed at its end remote from the plug housing, a wire filament-like resistance element being disposed in an insulating material within the tube, the resistance element consisting of two series-connected resistance filaments, of which the rear resistance filament, serving as a regulating filament, has a higher positive temperature resistance coefficient than the front resistance filament which is used as a heating filament, characterized in that the regulating filament which is made of material having a resistance at 1000° C. that is greater than its resistance at 20° C. by a resistance ratio over 7.5:1; and characterized in that the regulating filament is directly connected to an additional filament, the regulating filament being adjacent to the heating filament and the additional filament being adjacent to the tube of the glow plug housing and consisting of Ni.

16. A glow plug according to claim 4, characterized in that the regulating filament is directly connected to an additional filament, the regulating filament being adjacent to the heating filament, and the additional filament being adjacent to the tube of the glow plug housing and consisting of Ni.

* * * * *